US006299992B1

(12) United States Patent
Lindskog et al.

(10) Patent No.: US 6,299,992 B1
(45) Date of Patent: Oct. 9, 2001

(54) METHOD OF MAKING CEMENTED CARBIDE WITH BINDER PHASE ENRICHED SURFACE ZONE

(75) Inventors: Per Lindskog, Älvsjö; Per Gustafson, Huddinge, both of (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/242,683

(22) PCT Filed: Oct. 9, 1997

(86) PCT No.: PCT/SE97/01690

§ 371 Date: Aug. 25, 1999

§ 102(e) Date: Aug. 25, 1999

(87) PCT Pub. No.: WO98/16665

PCT Pub. Date: Apr. 23, 1998

(30) Foreign Application Priority Data

Oct. 11, 1996 (SE) ..... 9603758

(51) Int. Cl.[7] ..... B32B 19/00; B22F 3/00

(52) U.S. Cl. ..... 428/697; 428/552; 428/698; 428/699; 419/11; 419/15; 419/26; 75/236; 75/238; 75/242; 51/295; 51/307

(58) Field of Search ..... 428/332, 472, 428/697, 698, 469, 172, 699, 552; 51/295, 307, 309; 75/236; 419/18, 30, 34, 53, 11, 15, 26, 32

(56) References Cited

U.S. PATENT DOCUMENTS

| | | |
|---|---|---|
| 4,277,283 | 7/1981 | Tobioka et al. . |
| 4,548,786 | 10/1985 | Yohe . |
| 4,610,931 | 9/1986 | Nemeth et al. . |
| 4,649,084 | 3/1987 | Hale et al. . |
| 4,830,930 | 5/1989 | Taniguchi et al. . |
| 5,484,468 | 1/1996 | Ostlund et al. . |
| 5,549,980 | 8/1996 | Ostlund et al. . |
| 5,578,886 | 11/1996 | Holmlid et al. . |
| 5,643,658 | 7/1997 | Uchino et al. . |
| 5,729,823 | 3/1998 | Gustafson et al. . |

*Primary Examiner*—Donald J. Loney
(74) *Attorney, Agent, or Firm*—Burns, Doane, Swecker & Mathis, L.L.P.

(57) ABSTRACT

The present invention relates to method of making a cemented carbide insert, comprising a cemented carbide substrate and a coating. The substrate contains WC and cubic carbonitride phase in a binder phase based of Co and/or Ni and has a binder phase enriched surface zone essentially free of cubic phase. The binder phase enriched surface zone prevails over the edge. By sintering in an atmosphere essentially consisting of nitrogen the thickness of the binder phase enriched zone can be controlled.

16 Claims, 1 Drawing Sheet

METHOD OF MAKING CEMENTED CARBIDE WITH BINDER PHASE ENRICHED SURFACE ZONE

BACKGROUND OF THE INVENTION

The present invention relates to coated cemented carbide inserts with unique edge security in sticky work piece materials such as stainless steel, achieved with a binder phase enriched surface zone extending over the edge.

Coated cemented carbide inserts with binder phase enriched surface zone are today used to a great extent for machining of steel and stainless materials. Thanks to the binder phase enriched surface zone, an extension of the application area for the cutting material has been obtained.

Methods or processes to make cemented carbide containing WC, cubic phase (gamma-phase) and binder phase with binder phase enriched surface zones are known through a number of patents and patent application. According to, e.g., U.S. Pat. Nos. 4,277,283 and 4,610,931 nitrogen containing additions are used and sintering takes place in a vacuum whereas according to U.S. Pat. No. 4,548,786 the nitrogen is added in the gas phase. In both cases, a binder phase enriched surface zone essentially free of cubic phase is obtained. U.S. Pat. No. 4,830,930 describes a binder phase enrichment obtained through decarburization after the sintering whereby a binder phase enrichment is obtained which also contains cubic phase.

It is well known in the art that the thickness of the binder phase enriched zone decreases towards sharp corners, such as the cutting edge of a cutting insert, and that a brittle binder phase depleted zone, enriched in cubic phase, is present in the edge area and often limits the use of binder phase enriched cemented carbides especially in work piece materials with high demands on edge toughness.

However, the edges of a cutting insert has to be edge rounded to a certain radius of the order of 50–100 $\mu$m or less in order to be useful. The edge rounding is generally made after sintering by an edge rounding operation. In this operation, the thin outermost binder phase enriched zone is completely removed and the hard, brittle area is exposed. As a result, a hard but brittle edge is obtained resulting in an increased risk for problems with brittleness in the edge particularly in applications demanding high edge toughness.

One method of reducing this drawback of binder phase enriched sintered cemented carbides is described in U.S. Pat. No. 5,484,468. This method is, however, not sufficient in very difficult work piece materials such as austenitic stainless steel and may result in an unwanted decrease in the deformation resistance.

A method of maintaining the binder phase enriched zone in the edge portion of a cemented carbide insert is disclosed in EP-A-0569696. According to this application, this effect is obtained if Zr and/or Hf is present in the cemented carbide.

According to Swedish Patent application SE 9501383-5 the thickness of the binder phase enriched surface zone can be maintained over the edge also in cemented carbide free of Hf and Zr if certain conditions are fulfilled particularly with regard to the titanium and nitrogen content within the cubic phase as well as the overall carbon content. A favorable influence on the edge toughness in sticky materials such as austenitic stainless steel can thereby be obtained. However, the binder phase enriched zones according to this application often becomes to deep and difficult to control.

OBJECTS AND SUMMARY OF THE INVENTION

It is therefore an object of the present invention to provide a method of making a cemented carbide insert allowing a better control of the thickness of the binder phase enriched zone.

According to the presently claimed invention there is provided a cutting insert for machining of sticky work piece materials such as stainless steel comprising a cemented carbide substrate with a binder phase enriched surface zone and a coating, said substrate comprising a Co binder phase, WC and a cubic carbonitride phase of W and at least one of the metals Ti, Ta, Nb, Mo, V, or Cr, said binder phase enriched surface zone being essentially free of said cubic phase characterised in a thickness of said binder phase enriched surface zone of 15–45 $\mu$m on a flat surface of said insert and of 5–30 $\mu$m on a flat surface of said insert and of 5–30 $\mu$m in the cutting edge.

In another aspect of the invention, there is provided a method of making a cutting insert comprising a cemented carbide substrate with a binder phase enriched surface zone and a coating, said substrate comprising a binder phase of Co and/or Ni, WC and a cubic carbonitride phase, said binder phase enriched surface zone being essentially free of said cubic carbonitride phase and with an essentially constant thickness around the insert comprising forming a powder mixture containing WC, 6–14 atom-% binder phase and a 3–8 atom-% of Ti and at least one of Ta and Nb such that the Ti/(Ta+Nb) atomic ratio is >2 Ta and/or Nb being added as carbide and Ti as carbide, nitride and/or carbonitride in such proportions that the nitrogen content of the carbonitride phase expressed as x in the formula, (Ti,Nb,Ta)$(N_x,C_{1-x})$, is >0.2; adding to said powder mixture, a pressing agent and carbon as necessary such that the carbon content is 0–0.15 weight-% above the stoichiometric content; milling and drying the mixture to obtain a powder material; compacting and sintering the powder material such that between 1200° C. and pore closure, nitrogen gas is supplied to the furnace at 0–500 mbar; after which sintering is performed at a temperature of 1380–1520° C., in a protective atmosphere consisting essentially of nitrogen, the nitrogen pressure adjusted to impede gradient growth, with a period of sintering in an atmosphere without nitrogen, the time of this period adjusted to the gradient zone desired, followed by cooling according to standard practice; and forming a hard, wear resistant coating of single or multiple layers of at least one carbide, nitride, carbonitride, oxide or boride of at least one metal of the groups VB, VB and VIB of the periodic table and/or aluminum oxide.

DETAILED DESCRIPTION OF THE PREFERRED EMBODIMENTS OF THE INVENTION

Figure 1:
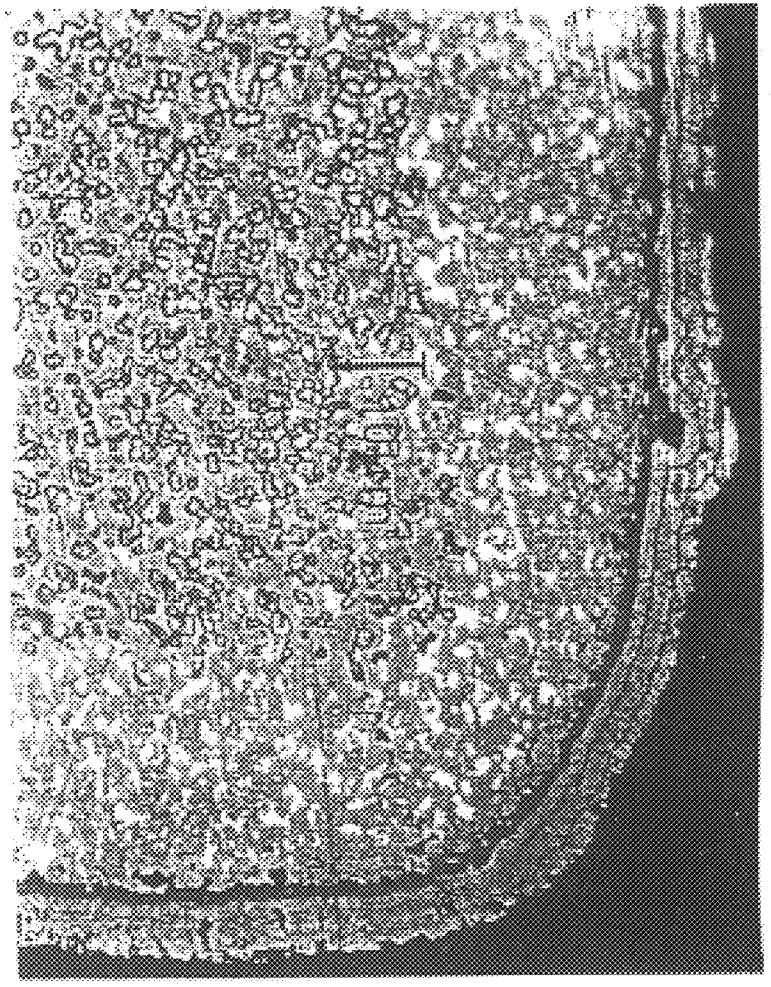
FIG. 1 shows in 800X the binder phase enriched zone under a cutting edge rounded to a 50 $\mu$m radius in a coated cemented carbide according to the invention.

It has now surprisingly been found that by performing part of the sintering under nitrogen pressure, the thickness of the binder phase enriched surface zone can be controlled with gradient prevailing in the vicinity of the edge. As a result, an insert of the present invention has improved edge toughness and is particularly useful for machining of sticky work piece materials such as stainless steels. Although the cubic phase is essentially a carbonitride phase, the material is herein referred to as a cemented carbide.

The invention, thus, relates to a method of making cutting inserts comprising a cemented carbide substrate consisting of a binder phase of Co and/or Ni, WC and a cubic carbonitride phase with a binder phase enriched surface zone essentially free of cubic phase and a coating. A powder mixture containing WC, 6–14 atom-%, preferably 8–11 atom-% binder phase and 3–8 atom-%, preferably 4–6 atom-% of Ti and at least one of Ta and Nb such that the Ti/(Ta+Nb) atomic ratio is >2, preferably >3 is formed. Ta and/or Nb is/are added as carbides whereas Ti is added as TiC, TiCN and/or TiN in such proportions that the nitrogen content of the carbonitride phase expressed as x in the formula, $(Ti,Nb,Ta)(N_x,C_{1-x})$ shall be >0.2, preferably 0.3–0.4. The powder mixture is mixed with a pressing agent and possibly carbon such that the carbon content is 0–0.15, preferably 0.05–0.15, weight-%, above the stoichiometric content and the mixture is milled and dried to obtain a powder material. Next, the powder material is compacted and sintered. During heating to sintering nitrogen gas may be supplied to the furnace at 0–500 mbar, preferably 10–40 mbar, in order to prevent denitrification prior to pore closure at temperatures above 1200° C. Sintering is performed at a temperature of 1380–1520° C., in a protective atmosphere consisting essentially of nitrogen, the nitrogen pressure adjusted to impede gradient growth, with a period of sintering in an atmosphere without nitrogen, the time of this period adjusted to obtain the gradient zone depth desired. The nitrogen pressure required to impede gradient growth depends on composition of the carbide body, sintering temperature and on the furnace used. The time required in atmosphere without nitrogen addition depends on sintering temperature and furnace used. It is within the purview of the skilled artisan to determine whether the requisite binder phase enrichment has been obtained and to modify the sintering conditions in accordance with the present specification, if desired, to effect the desired binder phase enrichment.

Cooling can be performed according to standard practice or as disclosed in U.S. Pat. No. 5,484,468. After conventional post sintering treatments including edgerounding a hard, wear resistant coating according to above is applied by CVD-, PVD- or MT-CVD-technique.

The present invention also relates to a cutting insert comprising a cemented carbide substrate with a binder phase enriched surface zone and a coating, said substrate comprising a binder phase of Co and/or Ni, WC and a cubic carbonitride of W, Ti and at least one of the metals Ta, Nb, Mo, V, or Cr with a binder phase enriched surface zone being essentially free of cubic phase.

Preferably the cemented carbide contains 6–14 atom-%, most preferably 8–11 atom-%, binder phase, 3–8 atom-%, most preferably 4–6 atom-%, of Ti and at least one of Ta and Nb and rest WC. The average WC grain size shall be between 1.0 and 4 μm, preferably between 1.5 and 3 μm. The Ti/(Ta+Nb) atomic ratio in the carbonitride phase shall be >2, preferably >3, with a nitrogen content expressed as x in the formula, $(Ti,Nb,Ta)(N_x,C_{1-x})$ >0.2, preferably between 0.3 and 0.4. The depth of the binder phase enriched surface zone close to the edge increases with increased titanium and nitrogen content within the cubic phase and with increased overall carbon content. The maximum nitrogen content that can be used in practice is mainly limited by the increased tendency for A and B type of porosity with increased nitrogen content. However, the maximum nitrogen content can be extended over the above stated limit if the sintering is performed in an inert atmosphere under high pressure. The maximum carbon content that can be used in practice is mainly limited by an increased tendency for carbon precipitation in the binder phase enriched surface zone, reduced coating adhesion and reduced deformation resistance. The carbon content shall correspond to a C-porosity better than C08, preferably C00 just below carbon saturation.

The thickness of the binder phase enriched surface zone shall be 1. below a flat surface 15–45 μm, preferably 25–35 μm 2. close to a sharp edge, before edge rounding, measured perpendicular to the same flat surface as in 1. above, 0.5–1.2 times the gradient zone in 1. above, preferably 0.67–1.2 times the gradient zone in 1. above.

3. at the edge after edge rounding 5–30 μm, preferably 10–25 μm.

The gradient zone depth close to the edge depends on the geometry, a blunt, 90 degrees or more, geometry giving deeper gradient zones.

Inserts according to the invention shall preferably have a coating of TiC, TiCN and/or TiN with a total coating thickness of 3–10 μm, most preferably 4–8 μm, possibly in combination with an $Al_2O_3$ coating with a thickness of 1–4 μm, most preferably 1.5–3 μm. Other coatings known in the art can also be used such as single or multiple layers of at least one carbide, nitride, carbonitride, oxide or boride of at least one metal of the groups IVb, VB and VIB of the periodic table and/or aluminium oxide by known CVD-, PVD- or MT-CVD-methods.

The invention is additionally illustrated in connection with the following Examples which are to be considered as illustrative of the present invention. It should be understood, however, that the invention is not limited to the specific details of the Examples.

EXAMPLE 1

According to Invention

From a powder mixture comprising 1.69 weight-% TiC, 1.28 weight-% TiN, 1.21 weight-% TaC, 0.76 weight-% NbC, 7.5 weight-% Co, and balance WC with 0.12 weight-% overstoichiometric carbon content, turning inserts CNMG120408 were pressed. The inserts were sintered with $H_2$ up to 450° C. for dewaxing, further in vacuum to 1200° C., and after that with a protective gas of 40 mbar nitrogen up to 1380° C. the furnace was then evacuated and filled with nitrogen to 60 mbar and heated to sintering temperature, 1450° C., and held there for 60 minutes, during these 60 minutes the furnace was evacuated for 15 min and then refilled with nitrogen.

The structure in the surface of the cutting inserts consisted of a 30 μm thick binder phase enriched zone below the flat flank face with a minimum if 25 μm close to the edge.

EXAMPLE 2

According to Invention

From a powder mixture comprising 1.69 weight-% TiC, 1.28 weight-% TiN, 1.21 weight-% TaC, 0.76 weight-% NbC, 7.5 weight-% Co, and balance WC with 0.12 weight-% overstoichiometric carbon content, turning inserts CNMG120408 were pressed. The inserts were sintered with $H_2$ up to 450° C. for dewaxing, further in vacuum to 1200° C., and after that with a protective gas of 40 mbar nitrogen up to 1380° C. the furnace was then evacuated and filled with nitrogen to 200 mbar heated to sintering temperature, 1450° C., and held there for 10 minutes and then cooled to 1380° C., evacuated and held at 1380° C. for 50 minutes and then cooled.

The structure in the surface of the cutting inserts consisted of a 33 μm thick binder phase enriched zone below the flat flank face with a minimum if 23 μm close to the edge.

EXAMPLE 3

Prior Art

From a powder mixture comprising 1.69 weight-% TiC, 1.28 weight-% TiN, 1.21 weight-% TaC, 0.76 weight-% NbC, 7.5 weight-% Co, and balance WC with 0.12 weight-% overstoichiometric carbon content, turning inserts CNMG120408 were pressed. The inserts were sintered with $H_2$ up to 450° C. for dewaxing, further in vacuum to 1200° C., and after that with a protective gas of 40 mbar nitrogen up to 1380° C. the furnace was then evacuated and filled with argon to 40 mbar heated to sintering temperature, 1450° C., and held there for 1 hour and then cooled.

The structure in the surface of the cutting inserts consisted of a 46 μm thick binder phase enriched zone below the flat flank face with a minimum if 30 μm close to the edge.

EXAMPLE 4

Prior Art

From a powder mixture comprising 1.69 weight-% TiC, 1.28 weight-% TiN, 1.21 weight-% TaC, 0.76 weight-% NbC, 7.5 weight-% Co, and balance WC with 0.12 weight-% overstoichiometric carbon content, turning inserts CNMG120408 were pressed. The inserts were sintered with $H_2$ up to 450° C. for dewaxing, further in vacuum to 1380° C. the furnace was then filled with argon to 40 mbar heated to sintering temperature, 1410° C., and held there for 1 hour and then cooled.

The structure in the surface of the cutting inserts consisted of a 40 μm thick binder phase enriched zone below the flat flank face with a minimum if 26 μm close to the edge.

EXAMPLE 5

Comparative

From a powder mixture comprising 1.69 weight-% TiC, 1.28 weight-% TiN, 1.21 weight-% TaC, 0.76 weight-% NbC, 7.5 weight-% Co, and balance WC with 0.12 weight-% overstoichiometric carbon content, turning inserts CNMG120408 were pressed. The inserts were sintered with $H_2$ up to 450° C. for dewaxing, further in vacuum to 1200° C., and after that with a protective gas of 40 mbar nitrogen up to 1380° C. the furnace was then evacuated and filled with nitrogen to 100 mbar heated to sintering temperature, 1450° C., and held there for 1 hour and then cooled.

The structure in the surface of the cutting inserts consisted of a 26 μm thick binder phase enriched zone below the flat flank face with a minimum if 12 μm close to the edge.

Examples 1 and 2 show that it is possible to control the depth of the gradient zone without loosing the desired gradient in the vicinity of the edge as in example 5. Examples 3 and 4 show that the gradient zone may grow excessively without nitrogen addition under a part of the sintering.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. Cutting insert for machining of sticky work piece materials comprising a cemented carbide substrate including a flat surface and a rounded cutting edge with a binder phase enriched surface zone and a coating, said substrate comprising a Co binder phase, WC and a cubic carbonitride phase of W and at least one of the metals Ti, Ta, Nb, Mo, V, or Cr, said binder phase enriched surface zone being essentially free of said cubic phase and having a thickness of said binder phase enriched surface zone of 15–45 μm on the flat surface of said insert and of 5–30 μm on the rounded cutting edge.

2. The cutting insert according to claim 1 wherein said substrate comprising 6–14 atom-% binder phase, 3–8 atom-% of Ti and at least one of Ta and Nb such that the Ti/(Ta+Nb) atomic ratio is >2 and that the nitrogen content of the carbonitride phase expressed as x in the formula, $(Ti,Nb,Ta)(N_x,C_{1-x})$, is >0.2.

3. The cutting insert of claim 2 wherein said Ti/(Ta+Nb) atomic ratio is >3.

4. The cutting insert claim 3 wherein x is from 0.3–0.4.

5. The cutting insert of claim 1 wherein said coating contains at least one of TiC, TiCN or TiN with a total coating thickness of 3–10 μm.

6. The cutting insert of claim 1 wherein said substrate comprises 8–11 atom % binder phase, 4–6 atom % of Ti, the Ti/(Ta+Nb)atomic ratio is >3 and the nitrogen content of the carbonitride phase is 0.3–0.4.

7. The cutting insert of claim 1, wherein the thickness of the binder-enriched surface zone on the flat surface is 25–35 μm.

8. The cutting insert of claim 7, wherein the thickness of the binder-phase enriched surface zone on the rounded cutting edge is 10–25 μm.

9. Method of making a cutting insert comprising a cemented carbide substrate with a binder phase enriched surface zone and a coating, said substrate comprising: a binder phase of at least one of Co or Ni; WC; and a cubic carbonitride phase, said binder phase enriched surface zone being essentially free of said cubic carbonitride phase and with an essentially constant thickness around the insert, the method comprising forming a powder mixture containing WC, 6–14 atom-% binder phase and a 3–8 atom-% of Ti and at least one of Ta and Nb such that the Ti/(Ta+Nb) atomic ratio is >2, Ta or Nb, or both being added as carbide, and Ti added as carbide, nitride, carbonitride, or combination thereof in such proportions that the nitrogen content of the carbonitride phase expressed as x in the formula, $(Ti,Nb,Ta)(N_x,C_{1-x})$, is >0.2;

adding to said powder mixture, a pressing agent and carbon such that the carbon content is 0–0.15 weight-% above the stoichiometric content;

milling and drying the mixture to obtain a powder material;

compacting and sintering the powder material, including the steps of heating the material in a vacuum to a temperature between 1200° C. and pore closure, then introducing nitrogen gas into the furnace at 0–500 mbar and sintering at a temperature of 1380–1520° C. in a protective atmosphere consisting essentially of nitrogen, the nitrogen pressure adjusted to impede gradient growth, with a period of sintering in an atmosphere without nitrogen, the time of this period adjusted to the gradient zone desired, followed by cooling; such that a binder phase enriched surface zone of 15–45 μm in thickness is formed below a flat surface of the insert, and a binder phase enriched surface zone of 0.5–1.2 times the thickness of the surface zone formed below the flat surface is formed close to a sharp edge of the cutting insert; and forming a hard, wear resistant coating of single or multiple layers of at least one of: a carbide, nitride, carbonitride, oxide or boride of at least one metal of the groups IVB, VB and VIB of the periodic table; or aluminum oxide.

10. The method of claim 9 wherein the powder mixture contains 8–11 atom % of Ti, the Ti/(Ta+Nb) atomic ratio is >3 and the nitrogen content of the carbonitride phase is 0.3–0.4.

11. The method of claim 9 wherein nitrogen gas is supplied to the furnace at 10–40 mbar.

12. The method of claim 9 wherein sintering is performed at 1410–1450° C.

13. The method of claim 9 wherein the sintered body is edge ground before said coating step.

14. The method of claim 9, further comprising performing an edge rounding operation on the sharp edge of the cutting insert, thereby leaving a 5–30 $\mu$m thick binder enriched surface zone remains at the rounded cutting edge.

15. The method of claim 14, wherein a 10–25 $\mu$m thick binder enriched surface zone remains at the rounded cutting edge.

16. The method of claim 15, wherein the thickness of the binder phase enriched surface zone formed below the flat surface is 20–35 $\mu$m.

* * * * *